US011124909B2

(12) United States Patent
Gupta

(10) Patent No.: US 11,124,909 B2
(45) Date of Patent: Sep. 21, 2021

(54) LIGHTED MAGNIFYING NEEDLE THREADING FIXTURE

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 156 days.

(21) Appl. No.: 16/654,334

(22) Filed: Oct. 16, 2019

(65) Prior Publication Data

US 2020/0123687 A1 Apr. 23, 2020

Related U.S. Application Data

(60) Provisional application No. 62/747,594, filed on Oct. 18, 2018.

(51) Int. Cl.
*D05B 87/04* (2006.01)

(52) U.S. Cl.
CPC ..... *D05B 87/04* (2013.01)

(58) Field of Classification Search
CPC ..... D05B 87/00–04; A01K 91/04
USPC ..... D3/28
See application file for complete search history.

(56) References Cited

U.S. PATENT DOCUMENTS 1,909,662 A * 5/1933 Conners ..... G02B 25/02 359/803
2,544,063 A * 3/1951 Biederman ..... D05B 87/04 223/99
2,625,307 A * 1/1953 Pinkham ..... D05B 87/00 223/99
2,757,837 A * 8/1956 Dritz ..... D05B 87/00 223/99
2,804,710 A * 9/1957 Stilwell ..... A01K 91/04 289/17
3,339,438 A * 9/1967 Stover ..... B29C 73/08 81/15.7
3,402,957 A * 9/1968 Peterson ..... A01K 91/04 289/17
4,147,411 A * 4/1979 Barry ..... G02B 25/005 359/805
D288,622 S * 3/1987 Biemans ..... A01K 91/04 D3/28

(Continued)

FOREIGN PATENT DOCUMENTS

GB 344145 A * 3/1931
GB 476468 A * 12/1937

*Primary Examiner* — Ismael Izaguirre
(74) *Attorney, Agent, or Firm* — Robert S. Alexander; Ferrells, PLLC; Anna L. Kinney

(57) ABSTRACT

A lighted magnifying needle threading fixture is provided. The threading fixture includes an elongated body with a magnifier lens at one end, a rest surface defined at the other, and therebetween a downwardly protruding support terminating in two support feet, as well as a battery compartment. The magnifier lens has a diameter of between about 30 mm and about 60 mm. The support feet and rest surface support the magnifier between about one and about four inches above a planar surface. The downwardly protruding support has a needle receiving socket beneath the magnifier, and an LED between the magnifier and the socket. The magnification strength allows a needle protruding from the socket to be in focus if viewed from above at a distance of between about 4 and 6 inches. The fixture is balanced on a planar surface so that the socket, LED and magnifier are accessible from both below and above.

7 Claims, 10 Drawing Sheets

(56) References Cited

U.S. PATENT DOCUMENTS 4,972,979 A * 11/1990 Gordon ..... D05B 87/04
223/99
5,251,797 A * 10/1993 Martin ..... A01K 91/04
223/99

* cited by examiner

LIGHTED MAGNIFYING NEEDLE THREADING FIXTURE

CLAIM FOR PRIORITY

This Non-Provisional patent application is based on U.S. Provisional Patent Application Ser. No. 62/747,594, filed on Oct. 18, 2018, the priority of which is claimed, and the disclosure of which is incorporated by reference.

BACKGROUND OF THE INVENTION

Threading of a needle has to be one of the most difficult tasks. Doing it easily requires steady hands, almost perfect vision and, even then, supreme patience. Thus it is not surprising that numerous schemes have been advanced to address this task. There are schemes involving special needles (U.S. Pat. Nos. 4,539,923; 4,667,860; 4,995,536; 5,038,836; and 6,145,714 as well as US Patent Application Publication: US 2003/0071094 A1), semi-rigid expandable/collapsible structures (U.S. Pat. Nos. 4,422,564; 7,654,422; as well as US Patent Application Publications US 2004/0155073 A1; and US 2009/0277934 A1); to be inserted through the eye of the needle, partial solutions (U.S. Pat. Nos. 4,296,877; 4,832,240; 4,890,776; 6,170,722; as well as US Patent Application Publication US 2008/0169320 A1); and numerous elaborate contraptions, including many that are engineering nightmares, and therefore, even if they work, most likely, unduly expensive (U.S. Pat. Nos. 4,492,325; 4,557,408; 4,706,589; 4,911,341; 4,913,325; 6,045,016; 6,830,165 B2; 7,905,188; 9,085,841; US Patent Application Publications: US 2011/0000414 A1; US 2013/0152837 A1; and US 2015/0013582 A1). Closer to the mark are: U.S. Pat. Nos. 4,930,871; 4,930,871 and US Published Patent Application Publications 2014/0117603 A1; and US 2014/0265083 A1 relating to a ring mounted magnifier and needle holder combinations. Perhaps closest is U.S. Pat. No. 4,972,979 which is apparently a combination of a conventional flash light, small magnifying glass and rubber band to hold the needle and magnifying glass in place around the lens of the flashlight along with a thread cutter for good measure.

What has been lacking is an inexpensive, practical device usable even by those no longer blessed with perfect vision and rock steady hands to make threading of a needle, if not truly easy, then at least manageable without a great deal of hassle.

SUMMARY OF THE INVENTION

The Lighted Magnifying Needle Threading fixture of the present invention comprises an elongated body having a capaciously sized magnifier at one end thereof, a rest surface defined at the other, a medially spaced protruding support terminating in two support feet located between said magnifier and said rest surface, supporting said magnifier between about one and about four inches above the plane defined by said rest surface and two support feet, said protruding support having a needle receiving socket located in the frontal surface thereof beneath said magnifier, an LED being disposed between the magnifier and the socket, the power of said magnifier being adapted such that a needle protruding from said socket will be in focus if viewed from above at a distance of several inches, said fixture being balanced so that, when placed upon a planar surface adjacent an edge thereof, the socket, LED and magnifier are accessible from both below and above.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures.

DETAILED DESCRIPTION OF THE PREFERRED EMBODIMENT

The invention is described in detail below with reference to an embodiment. Such discussion is for purposes of illustration only. Modifications within the spirit and scope of the present invention, set forth in the appended claims, will be readily apparent to one of skill in the art. Terminology used herein is given its ordinary meaning consistent with the exemplary definitions set forth immediately below.

The transitional phrase "consisting essentially of" limits the scope of a claim to the specified materials or steps "and those that do not materially affect the basic and novel characteristic(s)" of the claimed invention. With respect to product claims, "consisting essentially of" and like terminology refers to the recited components and excludes other ingredients which would substantially change the basic and novel characteristics of the composition or article. Unless otherwise indicated or readily apparent, a composition or article consists essentially of the recited components when the composition or article includes 90% or more by weight of the recited components. That is, the terminology excludes more than 10% unrecited components.

Figure 1:
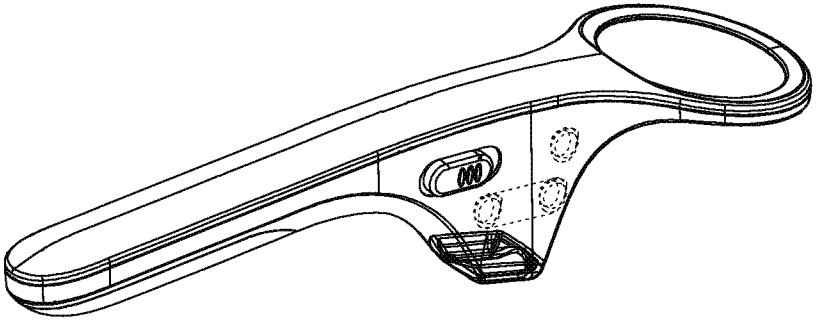
FIG. 1 is an isometric perspective of the lighted magnifying threading fixture of the present invention.
Figure 2:
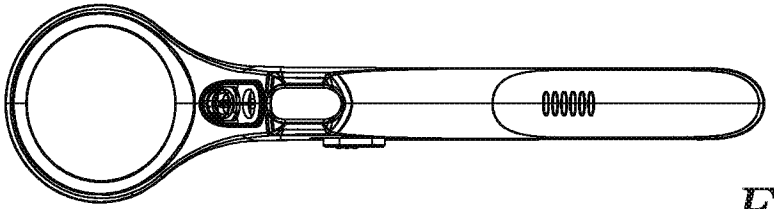
FIG. 2 is a plan view of the fixture of the present invention as viewed from below.
Figure 3:
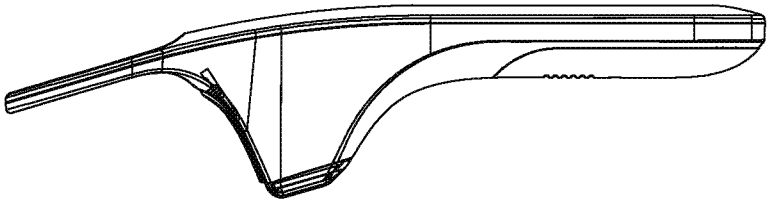
FIG. 3 is a side elevation of the present invention of the fixture of the present invention.
Figure 4:
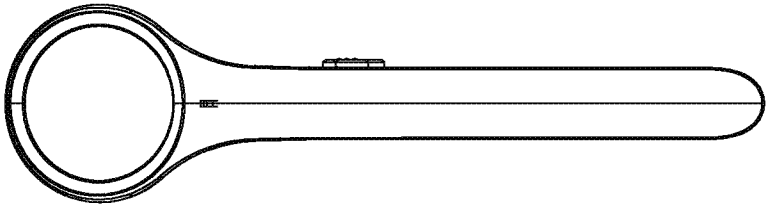
FIG. 4 is a plan view of the fixture of the present invention as viewed from above.
Figure 5:
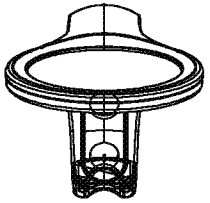
FIG. 5 is a front elevation of the fixture of the present invention.
Figure 6:
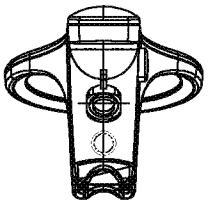
FIG. 6 is a rear elevation of the fixture of the present invention.
Figure 7:
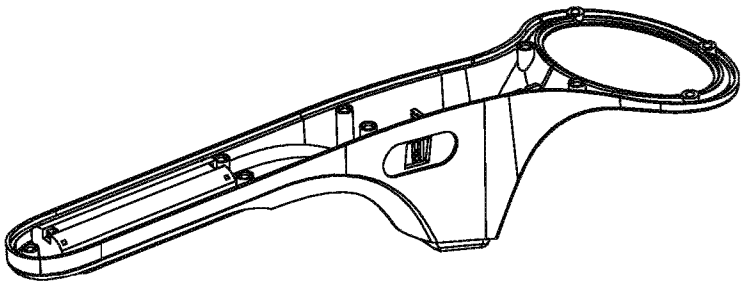
FIG. 7 is an isometric perspective of the body shell of the fixture of the present invention.
Figure 8:
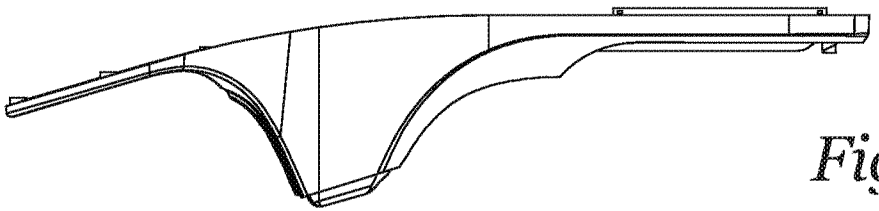
FIG. 8 is a side elevation of the body shell of the fixture of the present invention.
Figure 9:
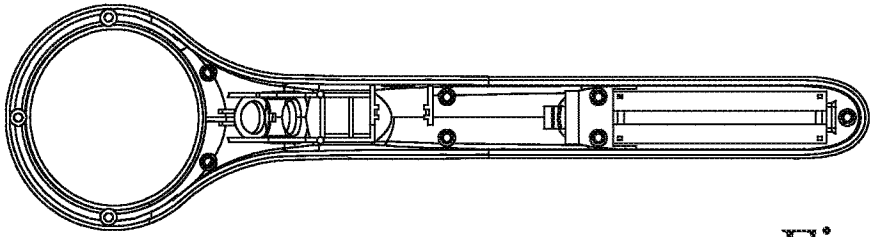
FIG. 9 is a plan view from above of the body shell of the fixture of the present invention.
Figure 10:
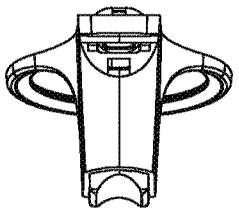
FIG. 10 is a front elevation of the body shell of the fixture of the present invention.
Figure 11:
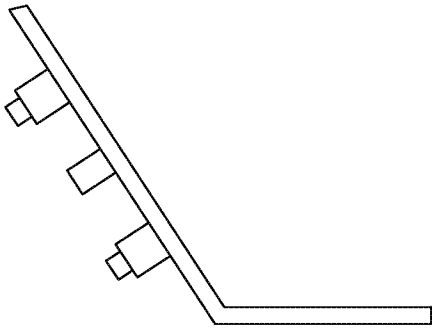
FIG. 11 is a side elevation of the LED/Needle Socket support bracket.
Figure 13:
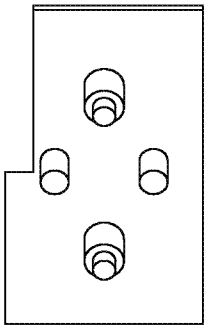
FIG. 13 is a front view of the LED/Needle Socket support bracket.
Figure 12:
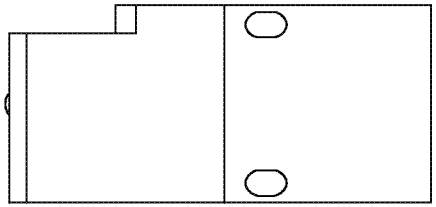
FIG. 12 is a top view of the LED/Needle Socket support bracket.
Figure 14:
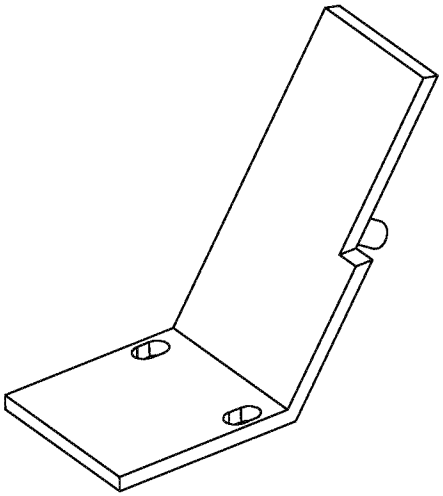
FIG. 14 is an isometric perspective of the LED/Needle Socket support bracket
Figure 15:
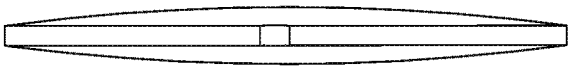
FIG. 15 is a side elevation of the magnifying lens used in the magnifier of the fixture of the present invention.
Figure 16:
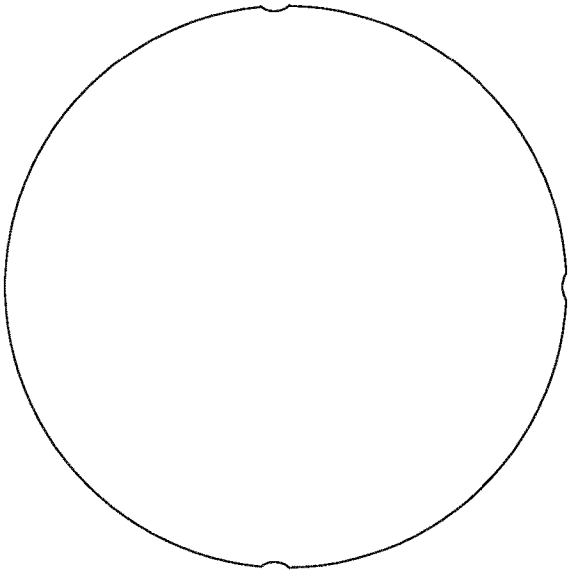
FIG. 16 is a plan view of the magnifying lens used in the magnifier of the fixture of the present invention.
Figure 17:
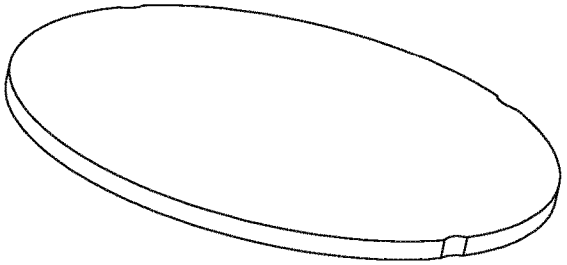
FIG. 17 is an isometric perspective the magnifying lens used in the magnifier of the fixture of the present invention.
Figure 18:
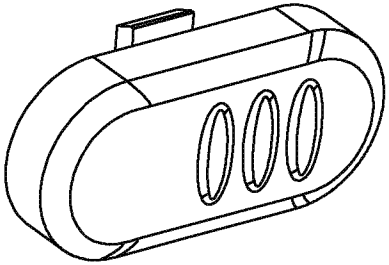
FIG. 18 is an isometric perspective of the activating slider used in the fixture of the present invention.
Figure 19:
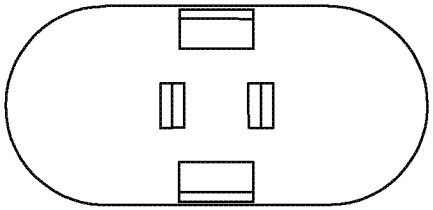
FIG. 19 is a plan view of the activating slider used in the fixture of the present invention as viewed from below.
Figure 20:
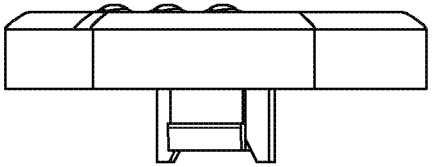
FIG. 20 is a side elevation of the activating slider used in the fixture of the present invention.
Figure 21:
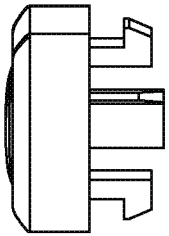
FIG. 21 is an end elevation of the activating slider used in the fixture of the present invention.
Figure 22:
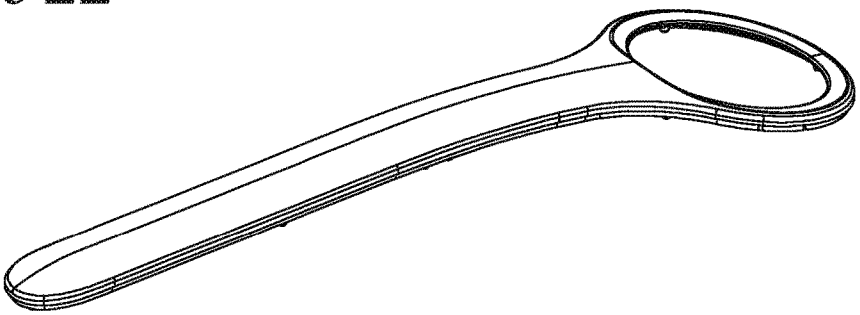
FIG. 22 is an isometric perspective of the top plate of the fixture of the present invention.
Figure 23:
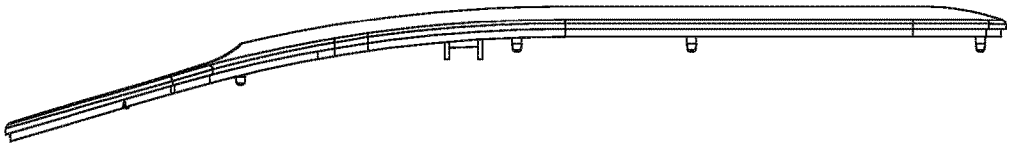
FIG. 23 is a side elevation of the top plate of the fixture of the present invention.
Figure 25:
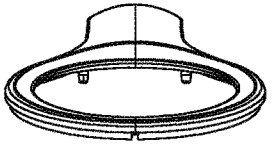
FIG. 25 is a front elevation of the top plate of the fixture of the present invention.
Figure 24:
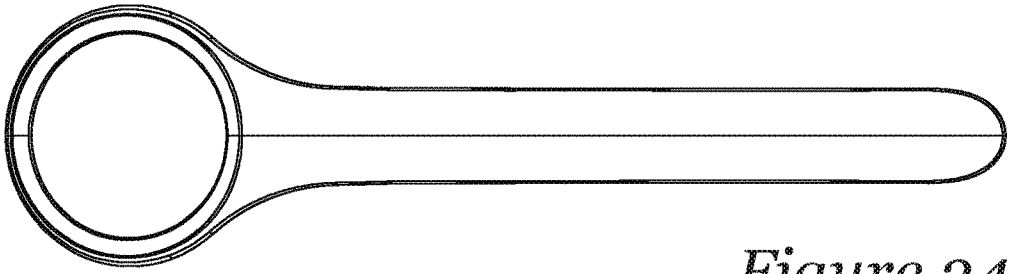
FIG. 24 is a plan view from above of the top plate of the fixture of the present invention.
Figure 28:
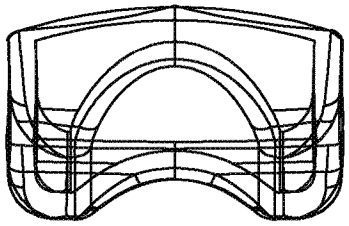
FIG. 28 is a front elevation of the support of the fixture of the present invention.
Figure 29:
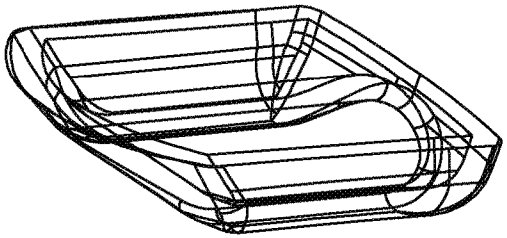
FIG. 29 is an isometric perspective of the support of the fixture of the present invention.
Figure 26:
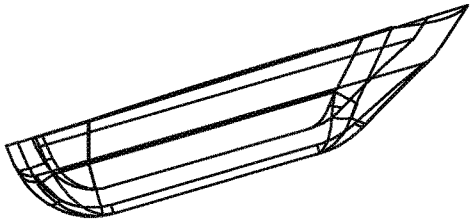
FIG. 26 is a side elevation of the support of the fixture of the present invention.
Figure 27:
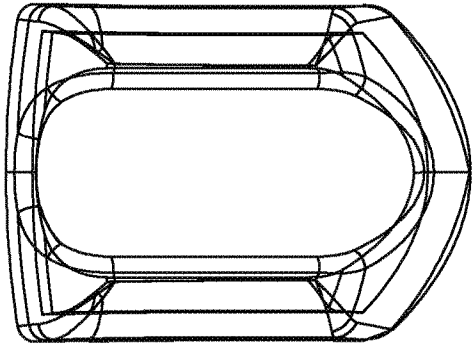
FIG. 27 is a plan view from below of the support of the fixture of the present invention.
Figure 30:
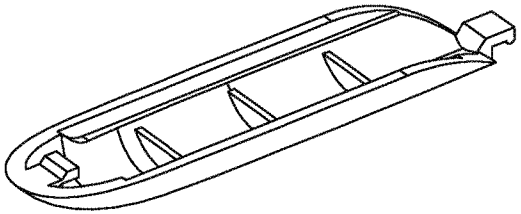
FIG. 30 is an isometric perspective of the battery receptacle cover of the fixture of the present invention.
Figure 31:
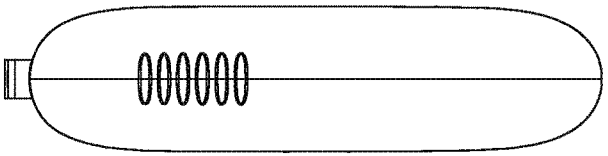
FIG. 31 is a plan view from below of the battery receptacle cover of the fixture of the present invention.
Figure 32:
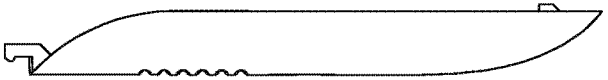
FIG. 32 is a side elevation of the battery receptacle cover of the fixture of the present invention.
Figure 34:
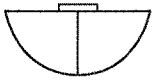
FIG. 34 is a rear elevation of the battery receptacle cover of the fixture of the present invention.
Figure 33:
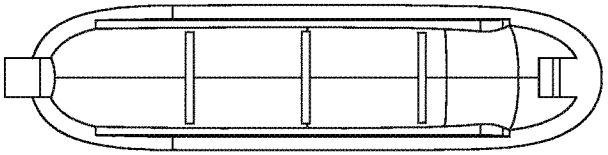
FIG. 33 is a plan view from above of the battery receptacle cover of the fixture of the present invention.
Figure 35:
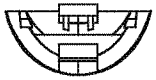
FIG. 35 is a front elevation of the battery receptacle cover of the fixture of the present invention.
Figure 36:
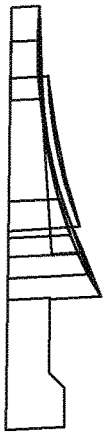
FIG. 36 is a side elevation of the LED holder of the fixture of the present invention.
Figure 39:
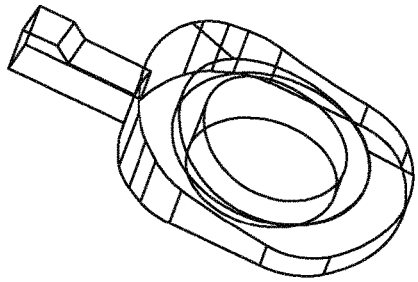
FIG. 39 is a frontal isometric perspective from below of the LED holder of the fixture of the present invention.
Figure 37:
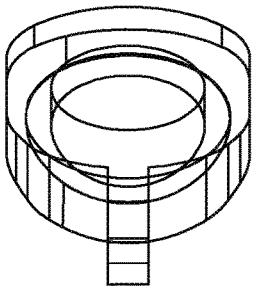
FIG. 37 is an RHS isometric perspective of the LED holder of the fixture of the present invention.
Figure 38:
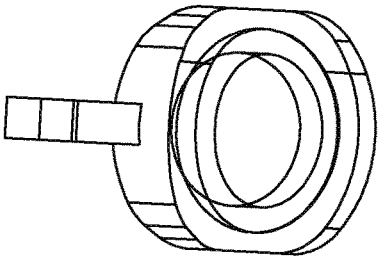
FIG. 38 is an isometric perspective from below of the LED holder of the fixture of the present invention.
Figure 40:
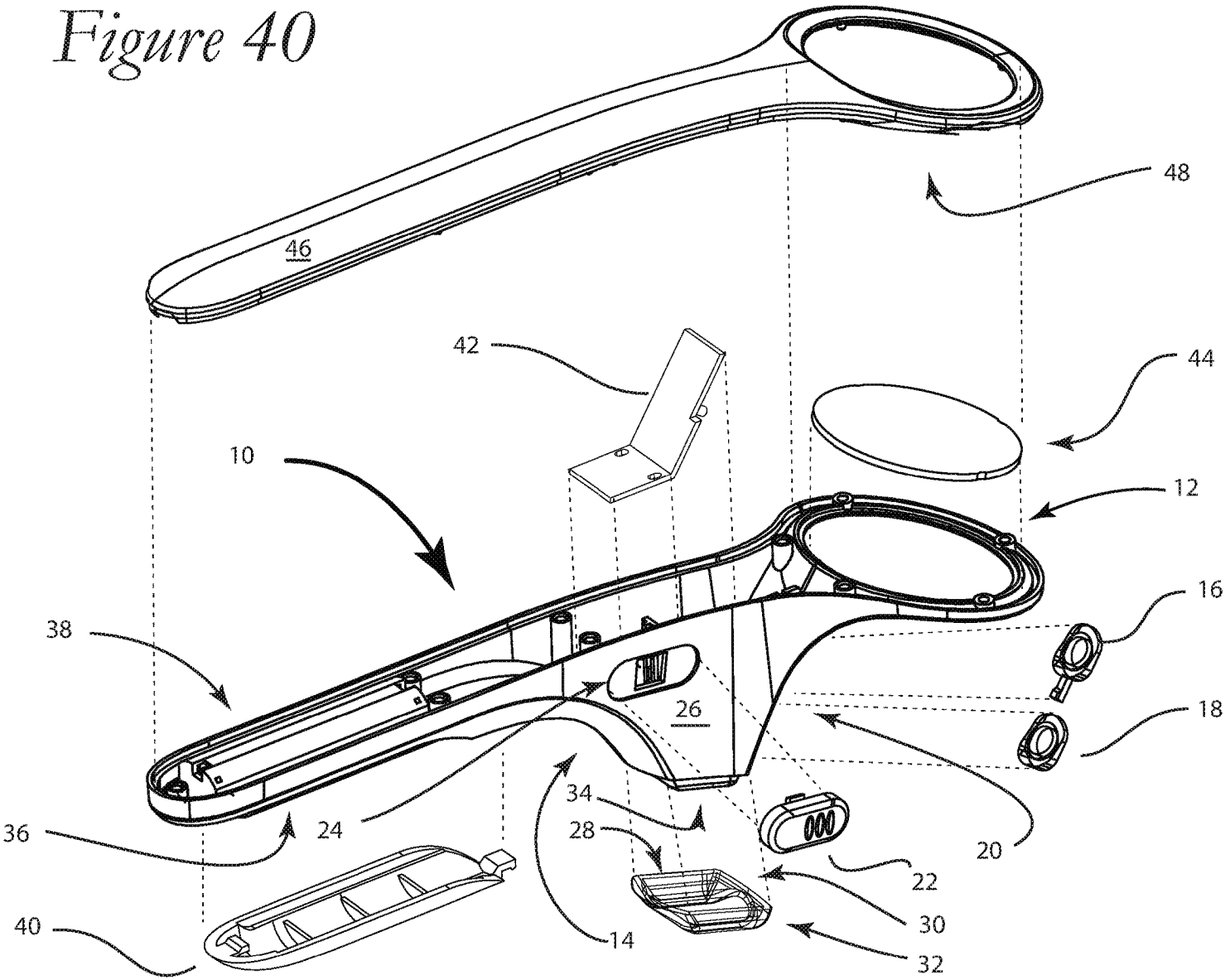
FIG. 40 is an exploded isometric perspective illustrating the interrelationship of the various parts illustrated in FIGS. 1-39.

FIGS. 1-39 illustrate the various components of the Lighted Magnifying Needle Threading Fixture of the present invention. FIG. 40 illustrates the interrelationship of these various components in the assembled fixture. Body 10 of the Lighted Magnifying Needle Threading Fixture of the present invention comprises lower lens receiving flange 12 at the distal end of body 10 adjoining medially located support/handle portion 14 having LED 16 and needle receiving socket 18 on distal surface 20 thereof. LED activation slider 22 is slidably mounted in slider receiving aperture 24 on lateral surface 26 of medially located support/handle portion 14. Mounting saddle 28 having support feet 30 and 32 is mounted on lower surface 34 of medially located support/handle portion 14 of body 10. Battery compartment 36 is formed in proximal portion 38 of body 10. Battery compartment cover 40 is adapted to seal battery compartment 36 while retaining conventional battery (not shown) therein. LED 16 and needle receiving socket 18 are held in position by LED/Socket retention bracket 42 received within medially located support/handle portion 14 while lens 44 having a magnification of between about 3× and about 5×, more preferably between about 3.5× and 4.5×, still more preferably between about 3.75× and 4.25×, is received by lower lens receiving flange 12 and retained there by top plate 46 having upper lens receiving flange 48 formed at the distal end thereof. Needle receiving socket 18 is located such that a needle (not shown) is located within the zone of focus of lens 44 when the eye of the user is placed about 6 to 12 inches above lens 44 with LED 16 being disposed between needle receiving socket 18 and lens 44 with light from LED 16 being directed generally parallel to the plane of lens 44 and the longitudinal axis of needle retaining socket 18. The dimensions of the Lighted Magnifying Needle Threading Fixture are chosen such that when a battery is retained within battery compartment 36, support feet 30 and 32 may be placed adjacent the edge of a support surface such as a sewing table with lens 44 overhanging that edge and the user can use both hands to manipulate thread through the eye of the needle, perhaps using one hand to position a leading portion of the thread through the needle and using the other to draw it through once it has entered the eye. LED activation slider 22 is operably connected to a battery and LED 16 by conventional circuitry (not shown) such that LED 16 may be activated and deactivated by manipulation of LED activation slider 22. Needle retaining socket 18 is preferably filled with a yieldable, deformable material to a depth of at least about ½", preferably at least about ¾" and most preferably to a depth of least about 1" such that needles of most conventional lengths can be held in position under lens 44. The diameter of lens 44 is preferably between 30 mm and 60 mm, more preferably between about 35 mm and 55 mm, still more preferably between about 40 mm and 50 mm so that the user can easily locate the eye of the needle within the field of view.

Proximal portion 38 of body 10 extends away from medially located support/handle portion 14 sufficiently that placing a battery within battery compartment 36 allows support feet 30 and 32 to be placed adjacent the edge of a support surface such as a sewing table with lens 44 overhanging that edge.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

I claim:

1. A lighted magnifying needle threading fixture, comprising:

an elongated body having a capaciously sized magnifier lens having a diameter of between about 30 mm and about 60 mm at one end thereof, a rest surface defined at the other, a medially spaced downwardly protruding support terminating in two support feet located between said magnifier and said rest surface, the combination of said support feet and said rest surface supporting said magnifier between about one and about four inches above the plane defined by said rest surface and two support feet, said downwardly protruding support having a needle receiving socket located in the frontal surface thereof beneath said magnifier, an LED being disposed between the magnifier and the socket, the power of said magnifier being adapted such that a needle protruding from said socket will be in focus if viewed from above at a distance of between about 4 and about 6 inches, a battery compartment located away from said magnifier adjacent said rest surface and adapted to supply power to said LED, said fixture being balanced so that, when a battery is retained within said battery compartment and said fixture is placed upon a planar surface adjacent a free edge thereof, the socket, LED and magnifier are accessible from both below and above.

2. The lighted magnifying needle threading fixture of claim 1, wherein said lens has a magnification of between about 3× and about 5×.

3. The lighted magnifying needle threading fixture of claim 1, wherein said lens has a magnification of between about 3.5× and about 4.5×.

4. The lighted magnifying needle threading fixture of claim 1, wherein said lens has a magnification of between about 3.75× and about 4.25×.

5. The lighted magnifying needle threading fixture of claim 1, wherein the dimensions are chosen such that placing a battery within said battery compartment allows the support feet to be placed adjacent the edge of a rest surface such as a sewing table with said lens overhanging that edge.

6. The lighted magnifying needle threading fixture of claim 1, wherein said lens has a diameter of between about 35 mm and about 55 mm.

7. The lighted magnifying needle threading fixture of claim 1, wherein said lens has a diameter of between about 40 mm and about 50 mm.

* * * * *